United States Patent [19]

Barbillat

[11] Patent Number: 4,723,682

[45] Date of Patent: Feb. 9, 1988

[54] FLOATING ROOF TANKS FOR LIQUIDS, IN PARTICULAR TO STORAGE TANKS USED IN THE NUCLEAR POWER INDUSTRY

[75] Inventor: Claude Barbillat, Argenteuil

[73] Assignee: Electricite de France, France

[21] Appl. No.: 780,568

[22] Filed: Sep. 26, 1985

[30] Foreign Application Priority Data

Sep. 27, 1984 [FR] France ..... 84 14859

[51] Int. Cl.[4] ..... B65D 88/38; B65D 88/42

[52] U.S. Cl. ..... 220/227; 376/205; 376/293; 376/463; 220/219

[58] Field of Search ..... 376/293, 294, 295, 283, 376/203, 205; 220/227, 219, 216

[56] References Cited

U.S. PATENT DOCUMENTS

| | | | |
|---|---|---|---|
| 2,538,412 | 1/1951 | Cecil et al. | 220/227 |
| 2,712,395 | 7/1955 | Wiggins | 220/219 |
| 2,718,977 | 9/1955 | Wiggins | 220/227 |
| 4,199,074 | 4/1980 | Gammell et al. | 220/227 |
| 4,438,863 | 3/1984 | Wilson et al. | 220/227 |
| 4,495,137 | 1/1985 | Otsubo | 376/294 |
| 4,620,566 | 11/1986 | Gery et al. | 376/283 |

FOREIGN PATENT DOCUMENTS

| | | | |
|---|---|---|---|
| 2753909 | 6/1978 | Fed. Rep. of Germany | 376/293 |
| 0841839 | 5/1939 | France . | |
| 2148374 | 5/1985 | United Kingdom . | |

*Primary Examiner*—Deborah L. Kyle
*Assistant Examiner*—Daniel Wasil
*Attorney, Agent, or Firm*—McCormick, Paulding & Huber

[57] ABSTRACT

The invention relates to floating roof tanks for liquids, of the type comprising a cylindrical wall (2), a floating roof (3), and a flexible membrane (4) connecting the periphery of the floating roof to the wall. In accordance with the invention, the tank further includes an overflow duct for providing protection against over-filling when the roof (3) is in its top position. The overflow duct (26) is mounted on the outside of the tank and has an upsidedown U-shaped portion disposed at a height corresponding to a maximum predetermined level for liquid inside the tank when the roof is in its top position. The invention is applicable to the nuclear power industry for storage tanks for topping up the primary circuit of a nuclear reactor with de-gassed water.

4 Claims, 4 Drawing Figures

FLOATING ROOF TANKS FOR LIQUIDS, IN PARTICULAR TO STORAGE TANKS USED IN THE NUCLEAR POWER INDUSTRY

The invention relates to floating roof tanks for liquids.

BACKGROUND OF THE INVENTION

Such tanks are used, in particular in the nuclear power industry, as storage tanks for storing liquids such as de-gassed distilled water.

Very high reliability is required in this industry in the design of tanks, in order to eliminate any risk of operation being stopped, or worse still any deterioration of their essential component parts. It is also essential for operation to be safe without there being any risk of operating error. Furthermore, since such floating roof tanks are used for topping up the primary circuits of a nuclear reactor, it is necessary for the storage to be protected from the air so as to ensure that the stored liquid is of very high quality, for example, in this particular application de-gased water must have an oxygen content of no more than 100 $\mu g/l$ in order to avoid any risk of oxidation.

Conventionally, such floating roof tanks comprise a cylindrical wall and a floating roof which is surrounded by said wall, and which is connected to it in sealed manner by means of a flexible membrane. In order to preserve this flexible membrane connecting the periphery of the roof to the side wall of the tank, and in particular in order to avoid kinks forming therein and/or an uncontrolled application thereof against the wall of the tank under the effects of the pressure of the liquid contained in the tank, it is common practice for the space defined by the membrane and the wall of the tank, and in communication with the outside, to receive a counter-pressure liquid which acts essentially as a lubricant for the membrane when the roof moves, and which additionally, at least in some positions, serves to center the said roof relative to the cylindrical wall of the tank.

One of the problems in designing such flotating roof tanks lies in protecting them against being over-filled when the roof is in the top position. Following an erroneous operation it may happen that an attempt is made to over-fill the tank. In general, upward motion of the roof is limited by top stops provided at the top of the tank, e.g. around its wall, and if the pressure continues to rise within the tank while the roof is in abutment against its top stops, it is essential for means to be provided to protect the tank.

One known technique, as described, for example, in French patent specification No. 2526405, is to provide a valve on the roof, sometimes referred to as an overflow valve, in order to prevent the pressure from rising too high inside the tank, by allowing the entire input flowrate to escape beyond some threshold pressure. Such techniques are not satisfactory since the liquid passing through the valve during such a period of excess pressure flows directly into the roof caisson, which may cause it to sink and lead to many kinds of risk as it moves downwardly in a disorderly manner. Emptying the roof via the inside of the tank would be very difficult and complicated to provide since a high duct runs the danger of catching in the membrane, while a low duct would require a flexible length of pipework connected to the roof yet subjected on the outside to the pressure of the liquid inside the tank, i.e. to a pressure of about 1 bar in a tank which is about 10 m deep when the roof is in the high position.

Another known technique consists in providing a floating roof with a rigid outer belt sliding like a piston ring against the inside wall of the tank, with said belt unmasking an exit orifice when the roof is in its top position. Such a structure, for example as described in U.S. Pat. No. 2,712,395, is incompatible with using a volume of counter-pressure liquid received in a peripheral space defined by a membrane connecting the periphery of the roof to the side wall of the tank.

Outside the field of floating roof tanks, there exist other types of safety device for liquid tanks, for example, proposals have been made to use a compensation vessel which is separate from the tank. One such device is described in French patent specification No. 841839: the vessel contains a compensating liquid which is denser and immiscible with the stored liquid, and whose level is adjusted so as to automatically maintain a fixed pressure against the fixed roof of the tank. Such a device would not be appropriate for a floating roof tank having a volume of counter-pressure liquid, since it is used for very high overpressures. The present invention aims to avoid the above-mentioned drawbacks of the prior art.

One aim of the invention is thus to provide a floating roof tank whose structure makes it possible not only to provide safe protection against overpressure due to over-filling the tank with the roof is in its top position, but also makes it possible to remove excess liquid effectively in such an overfilled situation.

Another aim of the invention is to provide a structure for the tank which is both simple and reasonably cheap to manufacture.

Another aim of the invention is to preserve as much as possible of the liquid stored in the tank from contact with ambient air, which is particularly useful in nuclear power industry applications.

SUMMARY OF THE INVENTION

A floating roof tank for liquids in accordance with the invention includes the improvement whereby the protection means are essentially constituted by an overflow duct mounted outside the tank and on the wall thereof, said overflow duct having an upsidedown U-shaped portion and being disposed at a height corresponding to the predetermined maximum level of liquid in the tank when the roof is in its top position.

Preferably, the overflow duct communicates with the inside of the tank by an orifice provided through the bottom of the tank wall, which orifice is disposed, for example, below the level occupied by the fold in the flexible membrane, regardless of the position of the roof, and also below the position occupied by bottom stops provided inside the tank on which the roof comes to rest in its bottom position.

The overflow U-shaped duct is advantageously set to a level which is slightly higher than the level occupied by the liquid in the tank when the roof is in abutment against its top stops which define the top position of the roof. Finally, it is advantageous to provide a tube to break the siphon in the upsidedown U-shape and connect it to the overflow duct close to the top of the upsidedown U, said siphon breaking tube being open to the atmosphere at its other end.

BRIEF DESCRIPTION OF THE DRAWINGS

An embodiment of the invention is described by way of example with reference to the accompanying drawings, in which.

MORE DETAILED DESCRIPTION

Figure 1:
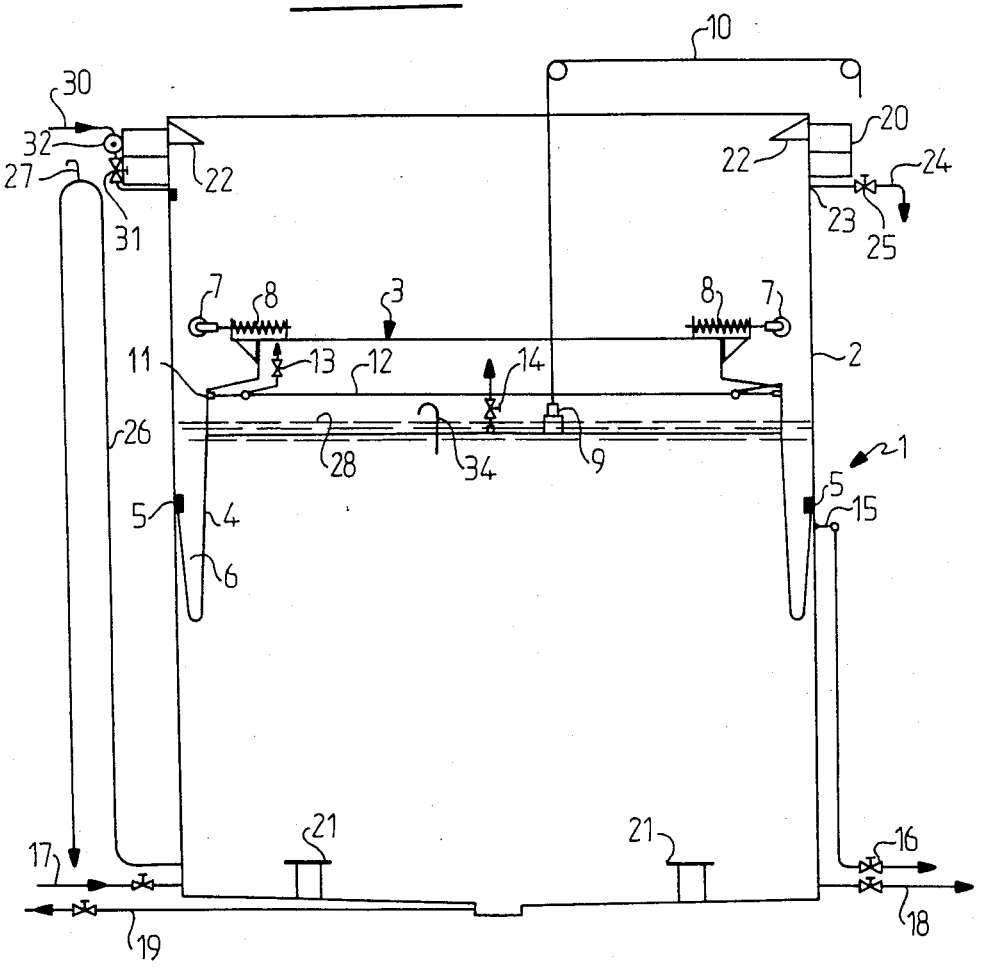
FIG. 1 is a vertical section through a floating roof tank in accordance with the invention.

In FIG. 1, a floating roof tank 1 for liquids has a generally cylindrical wall 2, a floating roof 3 in the form of an open-top caisson, and a flexible membrane 4 connecting the periphery of the floating roof in a watertight manner to the side wall of the tank. It should be noted that the membrane 4 is connected, in this case, halfway up the tank at 5, but that the invention is also applicable to a membrane connected further up the tank. In accordance with the conventional technique, the space 6 which is open to the outside as defined by the membrane 4 and the wall 2 of the tank is suitable for receiving a counter-pressure liquid whose main purpose is to lubricate the flexible membrane 4, and in particular to prevent kinks being formed therein due to movements of the floating roof 3, and which also serves, at least in some positions, to center the said roof relative to the tank wall.

FIG. 1 shows diagrammatically much of the equipment which is conventionally provided in conjunction with floating roof tanks for liquids. This equipment is described briefly, given that the person skilled in the art is familiar with such equipment.

The floating roof 3 is thus provided with six guide wheels 7 which are evenly distributed around the top of the roof and which are urged radially outwardly by springs 8 to press the wheels against the wall 2 of the tank in all possible positions of the roof. Advantageously, the size of the floating roof with its guide wheels always remains less than the diamter of the tank, to make it possible (although undesirable) for the roof to turn over completely without jamming against the wall of the tank. The floating roof 3 is also provided with an analog tilt-measuring device 9 connected via a cable 10 which has a degree of slack and a counter-weight to send alarm signals to a control room, thus enabling the slope of the roof to be monitored if it should catch in an intermediate position while operating in the lower portion of the tank or while emptying the tank. The floating roof 3 is also equipped, close to the membrane-roof junction with peripheral vents 11 connected via a venting manifold 12 which is fitted with a valve 13. The roof may also be fitted with an air bleeder 14 in the middle thereof supposing that its shape is such as to make it impossible to ensure that all of the air trapped under the roof can be evacuated via the peripheral vent 11. Finally, the floating roof is fitted with a vacuum-releasing tube 34 which forms a natural valve to protect the tank against the pressure of the liquid being excessively reduced while the tank is being emptied and when the roof is in its bottom position, or supposing the roof jams in a intermediate position (furthermore, if the roof does jam, the tube can also serve as an outlet should the pressure rise excessively).

The tank per se is fitted with manual venting means below the level of the join 5 between the membrane and the tank wall, said venting means including a plurality of vents uniformly distributed around the periphery of the tank and connected via a manifold 15 and a valve 16 to an outlet pipe. Inlet ducts 17 are provided at the bottom of the tank, as are outlet ducts 18, and emptying ducts 19, all of which ducts serve to convey the liquid stored in the tank. A circular gangway 20 is provided around the top of the tank to facilitate inspecting the roof and the membrane.

Movement of the floating roof is limited by bottom stops 21 and by top stops 22, and an indicator and alarm equipment (not shown) is provided to monitor the extreme full and empty positions in a control room.

Figure 2:
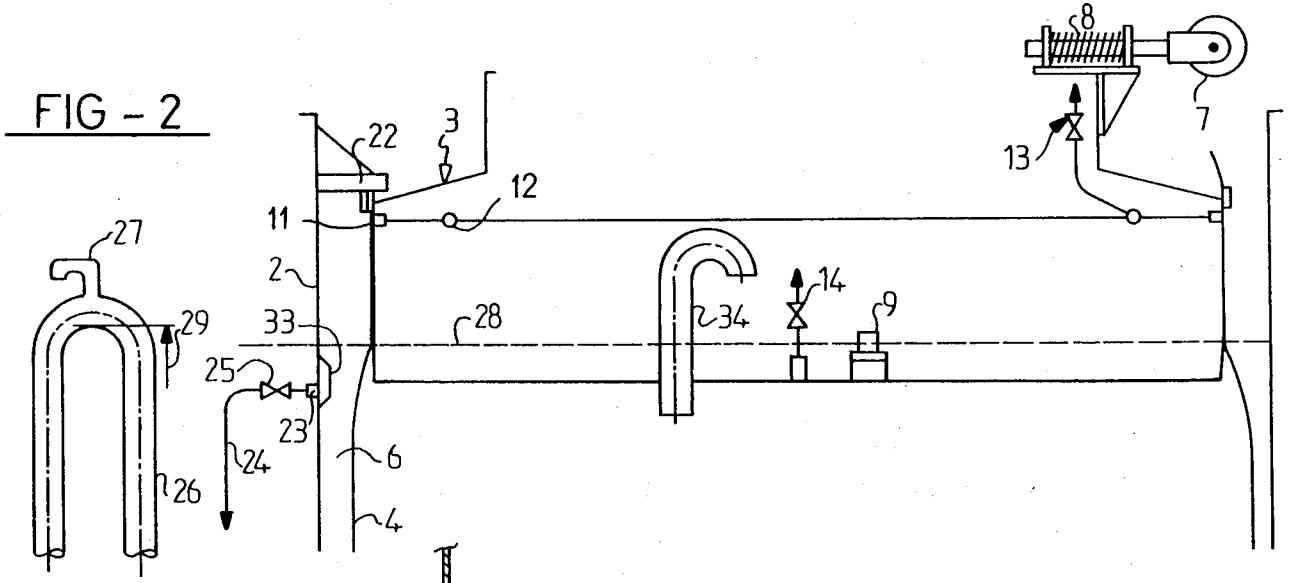
FIG. 2 is a section through a portion of a tank whose roof is in its high position.

The tank is fitted with means enabling the volume of counter-pressure liquid to be emptied when the roof is in its high position. As shown in FIGS. 1 and 2, these means comprise an emptying orifice 23 passing through the wall 2 near the top of the tank and connected to a conventional emptying pipe 24 fitted with a valve 25 and located outside the tank wall.

In order to empty the counter-pressure liquid, the tank is filled, thereby lifting the floating roof until it abuts against its top stops 22 (FIG. 2). In order to protect the tank against over-filling, it is provided, in accordance with the invention, with an upsidedown U-shaped overflow duct 26 having a siphon-breaking duct 27 at the top thereof to stop emptying the tank completely after it has started to overflow. In such a case, the tank is filled until the level of the liquid-line 28 (which is substantially the same as the level of the surface of the counter-pressure liquid) reaches the level 29 of the overflow, which is slightly above the level occupied at the beginning of top abutment, thereby providing additional safety and ensuring that the floating roof is indeed at its topmost position.

The overflow duct 26 communicates with the inside of the tank via an orifice provided through the wall of the tank near the bottom thereof, the level of said orifice being chosen to be below the fold in the membrane 4 regardless of the position of the roof so as to avoid any risk of the orifice being closed by the said membrane. This orifice is also preferably disposed lower down that the level of the bottom stops 21.

As mentioned above, the upsidedown U-shape of the duct 26 is preferably set to a level 29 (FIG. 2) which is higher than the liquid line 28 when the roof is just in abutment with the top stop.

The duct 26 thus contains a plug of liquid of variable volume which prevents any contact between the liquid contained in the tank and the ambient air, and thus prevents the liquid inside the tank from absorbing gas.

The tank is then isolated by closing the valve in the inlet duct 17, and then the valve 25 connected to the emptying orifice 23 is opened. This orifice is provided at a lower level than the level 28 of the liquid-line when the roof is in top abutment, and allows the entire volume of the counter-pressure liquid to be emptied under the natural effect of the pressure of the liquid inside the tank tending to urge the flexible membrane 4 radially outwardly, and thus to expel the counter-pressure liquid until the entire portion of the membrane which is lower than the emptying orifice is pressed against the inside wall of the tank. Counter-pressure liquid filling means are then actuated to admit a predetermined volume of counter-pressure liquid. These means are preferably disposed at the top of the tank at substantially the same level as the emptying means, and may be constituted, for example (see FIG. 1) by a duct 30, a valve 31, and a volume meter 32.

This emptying level is important, in particular, because when the emptying valve 25 is opened the roof moves slightly downwards as the counter-pressure liquid is expelled. It is important to be certain that the level 28 of the liquid line remains above the level of the emptying orifice 23 in order to ensure that the counter-pressure liquid is completely emptied.

Figure 4:
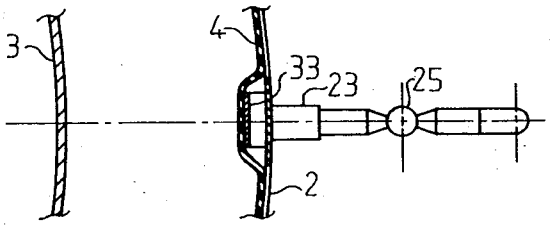
FIG. 4 is a section on IV—IV of FIG. 3.
Figure 3:
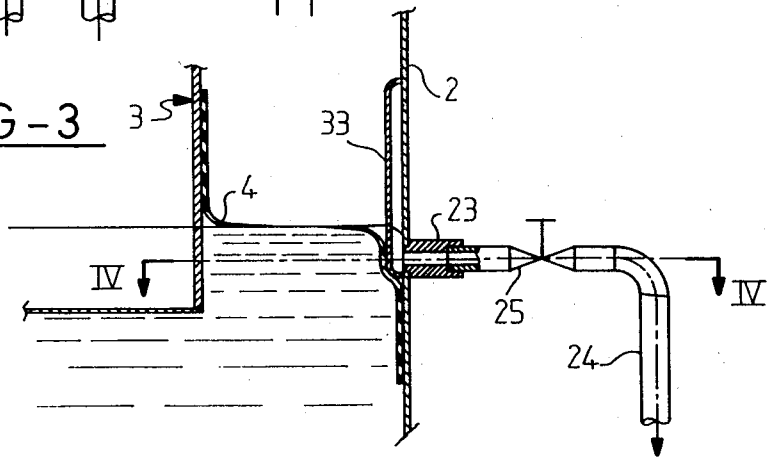
FIG. 3 is a section through a portion of the tank showing details of the members for emptying the counter-pressure liquid.

FIGS. 3 and 4 show means for ensuring that the emptying orifice is not closed by the flexible membrane while the counter-pressure liquid is being emptied. These means are constituted by a flat member 33 fixed to the side wall 2 and having a projecting portion which prevents the emptying orifice 23 from being closed while still allowing the liquid to pass around the flat member.

For applications in the nuclear power industry, the counter-pressure liquid is advantageously distilled water. The design of a floating roof tank in accordance with the invention thus makes it possible to avoid bringing the liquid in the tank into contact with the air, thereby avoiding the need to de-gas this liquid more than once (communication with atmospheric air via the siphon-breaking outlet of the overflow and via the vacuum-breaking tube cause only negligible disturbance since the siphon-breaking opening is far removed from its point of communication with the tank (at the bottom), and the vacuum-breaking tube includes a lower liquid plug which provides an effective screen).

Naturally the invention is not limited to the particular embodiment described by way of example, but extends to any variant, including the use of equivalent means, as defined by the following claims.

I claim:

1. A floating roof tank for liquids, the tank comprising a cylindrical wall, a floating roof surrounded by said cylindrical wall, a flexible membrane being fixedly connected to said floating roof and said wall in a watertight manner and having a fold defining a space which is suitable for receiving a counter-pressure liquid, and means for protecting the tank against being over-filled when the roof is in its top or uppermost position, the tank including the improvement whereby the protection means are essentially constituted by an overflow duct mounted outside the tank and on the wall thereof and communicating with the inside of the tank via an orifice provided through the bottom portion of said tank, said overflow duct having an upside down U-shaped portion and having the top of the upside down U-shaped portion disposed at a height corresponding to a predetermined maximum level of the liquid inside the tank when the roof is in its uppermost position, and a siphon-breaking tube connected to the overflow duct in the vicinity of the top of its upside down U-shaped portion and open at its other end to the outside atmosphere.

2. A floating roof tank according to claim 1, wherein the orifice is disposed at a level below the level occupied by the fold in the flexible membrane, regardless of the position of the roof.

3. A floating roof tank according to claim 1, wherein the orifice is disposed at a level below the level of bottom stops provided inside the tank and against which the roof comes into abutment in its bottom position.

4. A floating roof tank according to claim 1, wherein the top of the upside down U-shaped portion of the overflow duct is set at a level which is slightly higher than the level of the liquid inside the tank when the roof is brought into abutment against its top stops by filling the tank.

* * * * *